US005589747A

United States Patent [19]

Utke

[11] Patent Number: 5,589,747

[45] Date of Patent: Dec. 31, 1996

[54] LIGHT AND MOTION GOVERNED GARAGE DOOR OPENER LAMP

[76] Inventor: Michael C. Utke, 3204 - 31st St., Lubbock, Tex. 79410

[21] Appl. No.: 498,626

[22] Filed: Jul. 6, 1995

[51] Int. Cl.[6] ..... E05F 15/20

[52] U.S. Cl. ..... 318/468; 318/266; 318/286; 49/25

[58] Field of Search ..... 318/260–293, 318/460–480; 340/541; 250/206.1; 307/12–18; 49/25–31

[56] References Cited

U.S. PATENT DOCUMENTS

| | | | |
|---|---|---|---|
| 4,048,630 | 9/1977 | Deming et al. | 343/225 |
| 5,247,232 | 9/1993 | Lin | 318/468 |
| 5,412,297 | 5/1995 | Clark et al. | 318/468 |

*Primary Examiner*—Paul Ip

[57] ABSTRACT

A light and motion governed garage door opener lamp comprising an illumination system. Also included is a garage door opener system that produces a first electric signal upon the activation thereof. A sensor module includes a motion sensing mechanism capable of detecting the presence of one or more humans nearby and producing a second electrical signal upon the detection thereof. The sensor module further includes a light sensing mechanism having an open orientation when exposed to sufficient light for allowing the transmission of the first and second electric signals thereby allowing energization of the illumination system. The light sensor switch further has a closed orientation when exposed to insufficient light for precluding the transmission of the first and second electrical signals thereby preventing energization of the illumination system. The sensor module is also adapted to generate a temporal delay in extinguishment of said illumination system upon initial energization in the absence of detection of any human forms hence permitting a person to exit the sensing field of view momentarily and return without having the lamps cycle off and on.

4 Claims, 4 Drawing Sheets

LIGHT AND MOTION GOVERNED GARAGE DOOR OPENER LAMP

BACKGROUND OF THE INVENTION

1. Field of the Invention

The present invention relates to a new and improved light and motion governed garage door opener lamp and, more particularly, pertains to a sensory actuated garage door opener lamp which may be employed to illuminate an area surrounding a garage door upon detection of a moving human in proximity thereof solely when there is insufficient light.

2. Description of the Prior Art

The use of sensor actuated lights and electrically operated garage openers are known in the prior art. More specifically, sensor actuated lights and electrically operated garage door openers heretofore devised and utilized for illuminating areas in response to the motion or presence of a human and for opening and closing garage doors on command are known to consist basically of familiar, expected, and obvious structural configurations, notwithstanding the myriad of designs encompassed by the crowded prior art which has been developed for the fulfillment of countless objectives and requirements.

The prior art discloses a large number electrically operated garage openers. By way of example, U.S. Pat. No. 4,167,833 to Farina et al. discloses an overhead garage door opener comprising a motor driven capstan secured to the door and having a heavy cord wrappedly disposed upon the capstan and secured to a wall above the door at an end thereof and to a second wall at a second end thereof. U.S. Pat. No. Des. 312,053 to Jacobs et al. discloses an ornamental design of an infrared motion detector comprising a dual axis pivoting head enclosing structure applicable to various types of motion detectors employing infrared detection means. U.S. Pat. No. 4,247,806 to Mercier discloses a garage door opener comprising a radio receiver, a switching device and latching relay, a sensing circuit and foot switch detecting objects blocking free closing of the garage door and reversing motion thereof, and a radio transmitter for changing the operation modes of the system. U.S. Pat. No. Des. 269,072 to Sweet et al. teaches an ornamental design of a combined motion detector for actuating an enclosed lamp by a motion sensor signal. Lastly, U.S. Pat. No. 4,254,582 to McGee discloses an electrically actuated overhead garage door opener assembly.

In this respect, the light and motion governed garage door opener lamp according to the present invention substantially departs from the conventional concepts and designs of the prior art, and in doing so provides an apparatus primarily developed for the purpose of illuminating an area surrounding a garage door upon detection of a moving warmed object in proximity thereof solely when there is insufficient light.

Therefore, it can be appreciated that there exists a continuing need for a new and improved light and motion governed garage door opener lamp which can be used for illuminating an area surrounding a garage door upon detection of a moving warmed object in proximity thereof. In this regard, the present invention substantially fulfills this need.

SUMMARY OF THE INVENTION

In view of the foregoing disadvantages inherent in the known types of sensor actuated lights and electrically operated garage openers now present in the prior art, the present invention provides an improved light and motion governed garage door opener lamp. As such, the general purpose of the present invention, which will be described subsequently in greater detail, is to provide a new and improved light and motion governed garage door opener lamp and methods which have all the advantages of the prior art and none of the disadvantages.

To attain this, the present invention essentially comprises an electrically powered garage door opening and closing system including a garage door, housing and a plurality of lamps. A plurality of actuator switches are coupled to a power source and adapted to allow activation of the garage door system. A plurality of state switches determine the state of the garage door. A first relay is adapted to produce a first electric signal upon the activation thereof. Two additional relays are coupled to an upward motor and downward motor effecting operation of the door upon the activation thereof. An integrated circuit is coupled between the state switches and relays and adapted to activate the relays upon the selective activation of the actuator switches and state switches.

Further included is a sensor module including a sensor housing having a window which removes light wavelengths not included in the infrared domain. A passive monostatic infrared sensor element is disposed within the housing at a location near the window and is adapted to transmit a second electric signal upon the detection of a human form. A light sensor switch is coupled to the motion sensor element and the first relay. The light sensor switch has an open orientation when exposed to sufficient light for precluding the transmission of the first and second electric signals and a closed orientation when exposed to insufficient light for allowing the transmission thereof. Temporal delay circuitry is coupled to the light sensor switch and comprises an input power control line coupled to the power source and further comprises an output power control line coupled to the lamps of the garage door system. The temporal delay circuitry is adapted to allow transmission of current between the input power control line and output power control line upon the receipt of the first or second electric signal thereby allowing independent actuation of the lamps upon the detection of humans or activation of the garage door opener system and precluding such actuation upon exposure to sufficient light. The temporal delay circuitry further is adapted to remain activated after initial actuation for a predetermined amount of time despite the absence of motion.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved light and motion governed garage door opener lamp which has all the advantages of the prior art sensor actuated lights and electrically operated garage openers and none of the disadvantages.

It is another object of the present invention to provide a new and improved light and motion governed garage door opener lamp which may be easily and efficiently manufactured and marketed.

It is a further object of the present invention to provide a new and improved light and motion governed garage door opener lamp which is of a durable and reliable construction.

An even further object of the present invention is to provide a new and improved light and motion governed garage door opener lamp which is susceptible of a low cost of manufacture with regard to both materials and labor, and which accordingly is then susceptible of low prices of sale to the consuming public, thereby making such light and motion governed garage door opener lamp economically available to the buying public.

Still yet another object of the present invention is to provide a new and improved light and motion governed garage door opener lamp which provides in the apparatuses and methods of the prior art some of the advantages thereof, while simultaneously overcoming some of the disadvantages normally associated therewith.

Even still another object of the present invention is to provide a light and motion governed garage door opener lamp which can be easily retrofitted in an existing garage door opening and closing system.

Lastly, it is an object of the present invention to provide a light and motion governed garage door opener lamp comprising a garage door opener system that produces a first electric signal upon the activation thereof. Also included is an illumination system. A sensor module includes a motion sensing mechanism capable of detecting the presence of one or more humans nearby and producing a second electrical signal upon the detection thereof. The sensor module further includes a light sensing mechanism having an open orientation when exposed to sufficient light for allowing the transmission of the first and second electric signals thereby allowing energization of the illumination system. The light sensor switch further has a closed orientation when exposed to insufficient light for precluding the transmission of the first and second electrical signals thereby preventing energization of the illumination system. The sensor module is also adapted to generate a temporal delay in extinguishment of said illumination system upon initial energization in the absence of detection of any human forms hence permitting a person to exit the sensing field of view momentarily and return without having the lamps cycle off and on.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
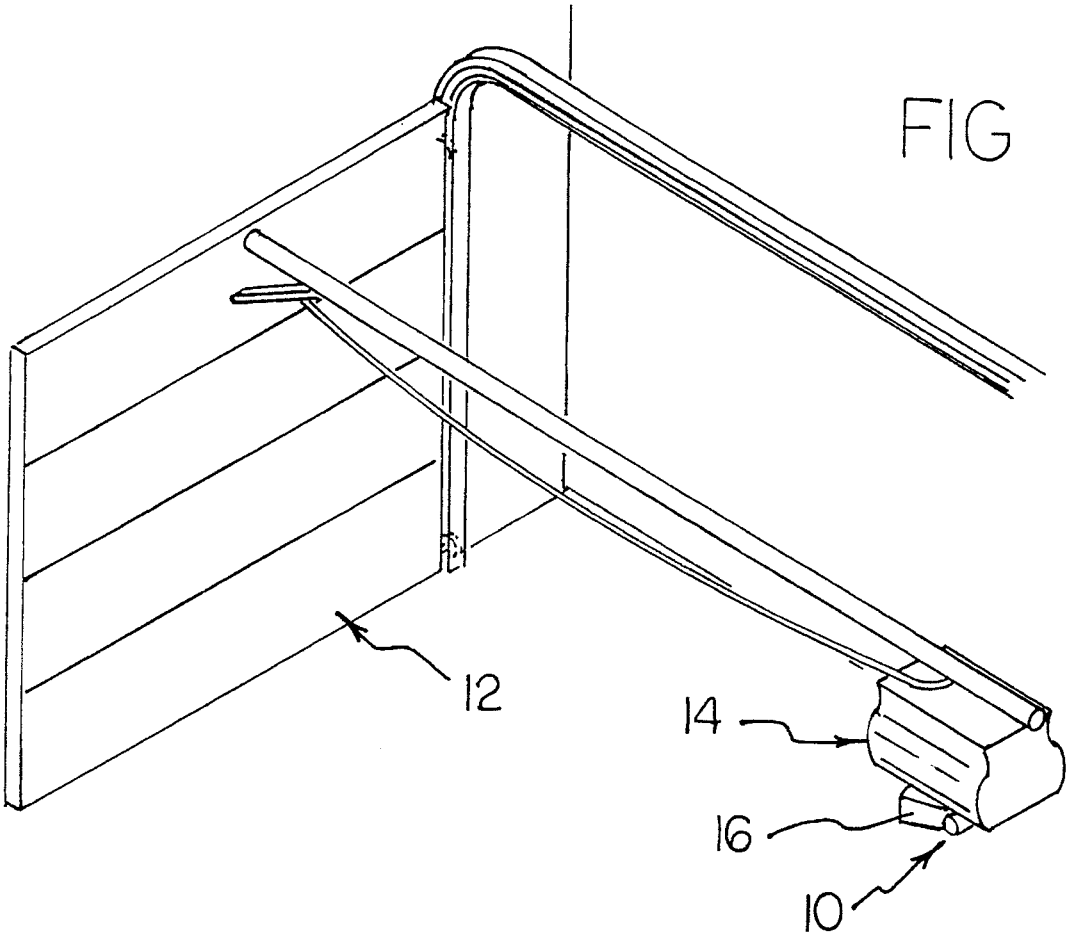
FIG. 1 is a perspective illustration of the preferred embodiment of the light and motion governed garage door opener lamp constructed in accordance with the principles of the present invention.
Figure 2:
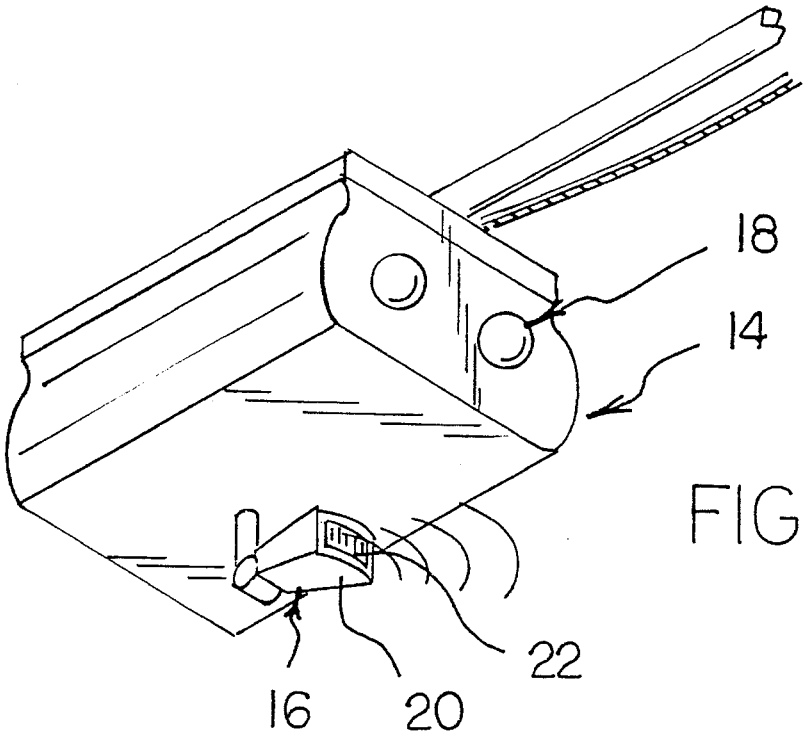
FIG. 2 is a perspective view of the light and motion governed garage door opener lamp showing disposition of an adjustable directivity sensor on a garage door opener.
Figure 3:
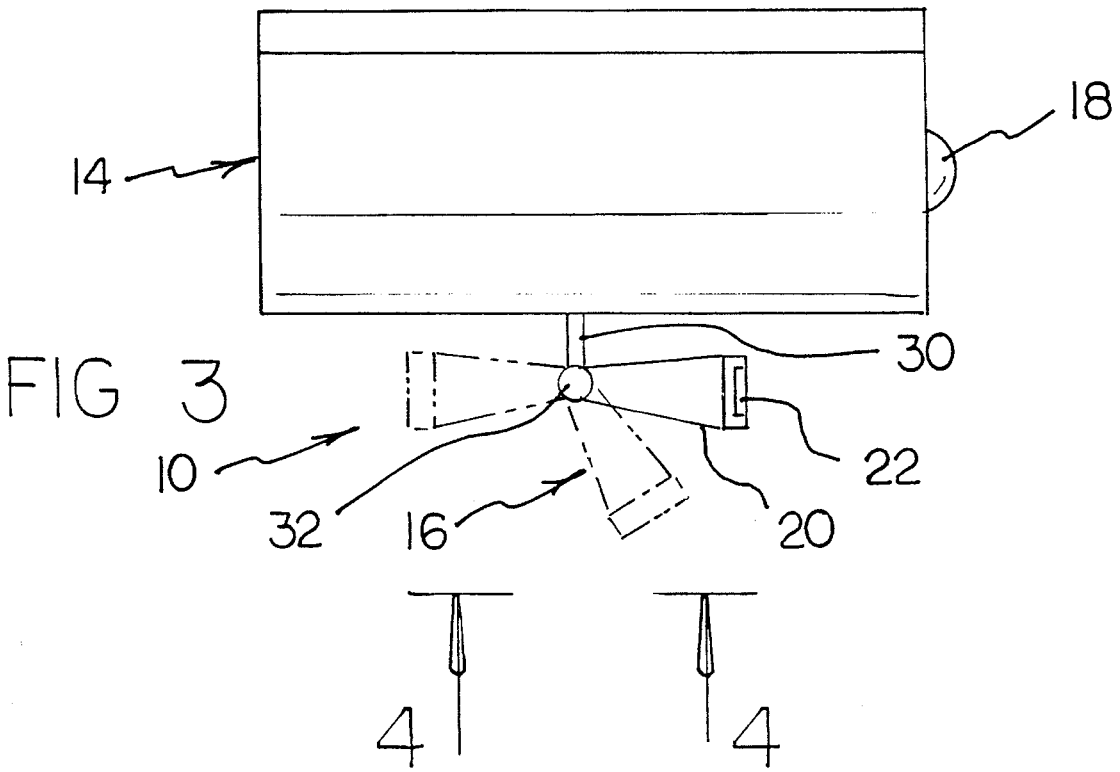
FIG. 3 is a side elevational view of the light and motion governed garage door opener lamp showing an adjustable directivity sensor on a garage door opener.
Figure 4:
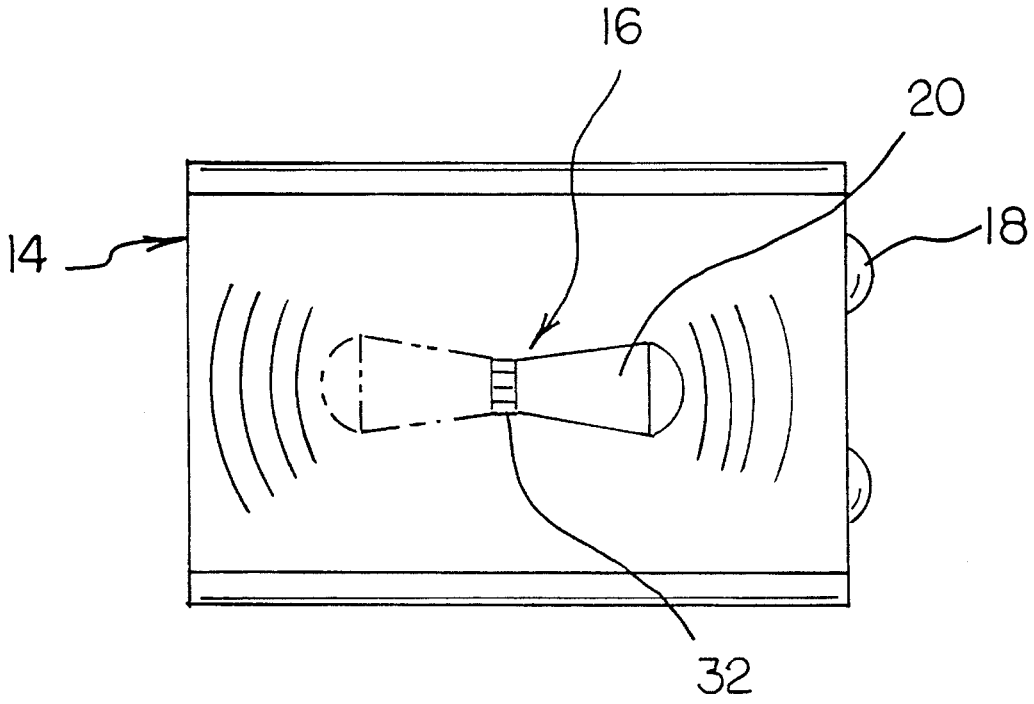
FIG. 4 is a side sectional view of a light and motion governed garage door opener lamp taken substantially upon the plane 4—4 of FIG. 3.
Figure 5:
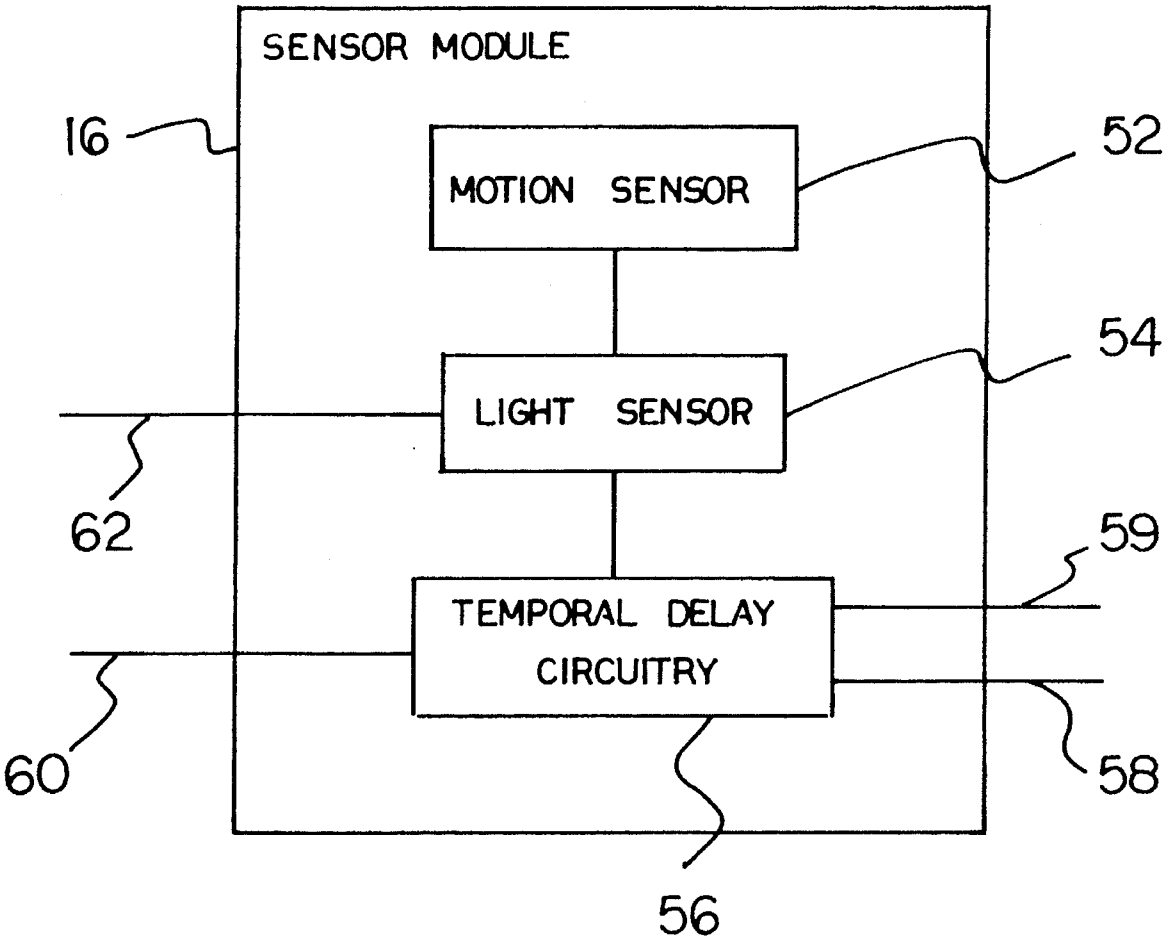
FIG. 5 is a schematic diagram depicting the circuitry incorporated in the sensor module.
Figure 6:
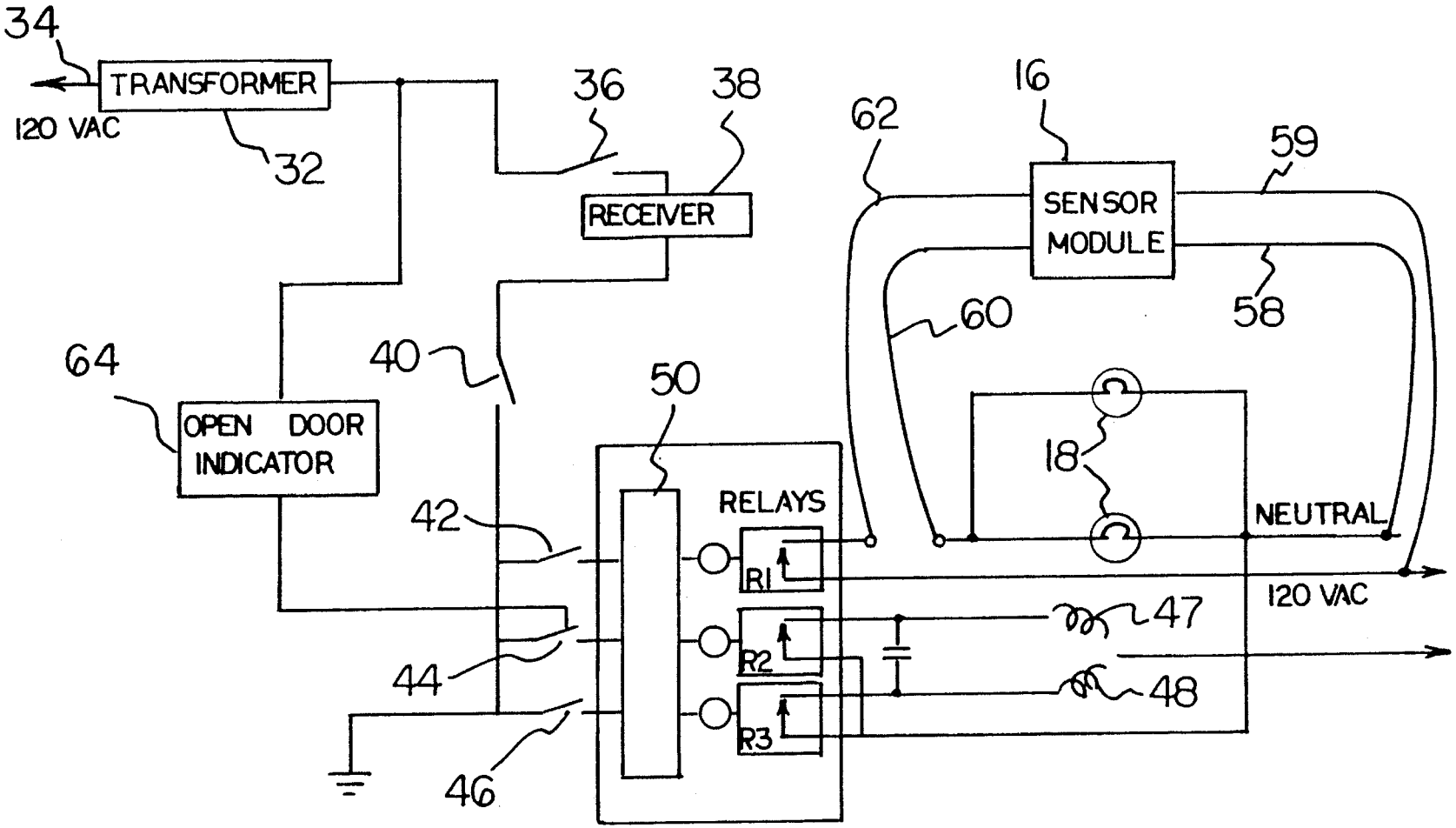
FIG. 6 is a schematic diagram depicting the circuitry required for the amalgamation of the garage door opener and sensor module.

With reference now to the drawings, and in particular to FIG. 1 thereof, the preferred embodiment of the new and improved light and motion governed garage door opener lamp embodying the principles and concepts of the present invention and generally designated by the reference numeral 10 will be described.

The present invention, the new and improved light and motion governed garage door opener lamp is a system 10 comprised of a plurality of components. In their broadest context, the components include a garage door opening and closing system and a sensor module. Each of the individual components is specifically configured and correlated one with respect to the other so as to attain the desired objectives.

More specifically, the system 10 of the present invention includes an electrically powered garage door opening and closing system comprising a garage door 12 and garage door system housing 14. Further included is an illumination system consisting of a plurality of lamps. A transformer 32 is coupled to a conventional power receptacle 34 and adapted to supply an acceptable amount of current to the system. A security switch 36 is coupled to the transformer with an open orientation for precluding operation of the system and a closed orientation for allowing normal operation thereof. A receiver switch 38 is coupled in series with the security switch and adapted to allow transmission of current upon receipt of a radio signal employed by a user. A manual switch 40 is coupled in series with the receiver switch and adapted to allow transmission of current upon the manual activation thereof. An upper limit switch 42 is coupled in series with the manual switch and adapted to allow transmission of current when the garage door is open. A lower limit switch 44 is coupled in series with the manual switch and adapted to allow transmission of current when the garage door is closed. An obstruction switch 46 is further coupled in series with the manual switch and adapted to allow transmission of current when the garage door is obstructed. An open door indicator 64 is coupled between the transformer and lower limit switch 44. The open door indicator is adapted to signal when the garage door is open.

The garage door system further includes a first relay R1 that transmits a first electric signal upon the activation thereof. A second relay R2 is coupled to an upward motor 47 to effect opening of the garage door upon the activation thereof. A third relay R3 is coupled to a downward motor 48 to effect closing of the garage door upon the activation thereof.

An integrated circuit 50 is coupled between the upper limit switch 42, lower limit switch 44, and obstruction switch 46 and the first relay R1, second relay R2, and third relay R3. The integrated circuit is adapted to activate the first relay R1, second relay R2, and third relay R3 upon the receipt of current via the upper limit switch 42, lower limit switch 44, and obstruction switch 46 thereby effecting normal operation of the garage door system.

Also included is a sensor module 16 including a sensor housing 20 having a plurality of passive monostatic infrared sensor elements 52 disposed within. The passive infrared sensor element detects body thermal emissions in the infrared spectral domain near a ten micron emission peak characteristic of the human skin at ninety eight degrees Fahrenheit. Passive infrared sensor elements are most frequently fabricated from pyroelectric elements such as poled polyvinylidine fluoride with vapor deposited electrodes deposited upon surfaces thereof. Individual pyroelectric elements can detect the infrared emission of a human form at ranges to several hundred feet and are well suited to detecting humans at ranges of interest in the tens of feet domain. Most passive infrared sensor elements used for detecting humans comprise a plurality of pyroelectric elements having substantially isolated serially adjoining fields of view wherein a human moving into or out of a region is detectible by differential signals emergent from the adjoining pyroelectric elements. The plurality of elements technique reduces false alarms from natural diurnal temperature variations and from fluctuations produced by in-house heating and ventilating systems.

The plurality of elements provides the passive infrared sensor with motion sensing capability, however there is generally a small time delay incurred for production of an output signal if a person moves slowly through any porion of the field of view. The passive infrared sensor element is inexpensive and is less susceptible to false alarm in most other alternate sensors of similar complexity and therefore is preferred for application in the light and motion governed garage door opener lamp. Upon the detection of one or more humans, the sensor elements are capable of producing a second electrical signal.

The housing of the sensor element further includes a window 22 for filtering wavelengths not included in the infrared domain. Various filtering materials may be incorporated in lieu of the above mentioned window for the purpose of enhancing the signal to noise ratio of the detectible signature particularly in the presence of strong background emissions outside the detection band.

A light sensor switch 54 is positioned within the sensor module 16 and coupled to the motion sensor element 52 and is further coupled to the first relay R1 via a relay control line 62. The light sensor switch has an open orientation when exposed to sufficient light which precludes the transmission of the first and second electric signals. The light sensor switch further has a closed orientation when exposed to insufficient light which allows the transmission of the first and second electric signals.

Temporal delay circuitry 56 is coupled to the light sensor switch 54. The temporal delay circuitry comprises an input power control line 59 coupled to the power receptacle and further comprises an input neutral control line 58. The temporal circuitry also includes an output power control line 60 coupled to the lamps 18 of the garage door system. The temporal delay circuitry is adapted to allow transmission of current between the input power control line and output power control line upon the receipt of the first or second electric signal thereby allowing independent actuation of the lamps upon the detection of humans or activation of the garage system and precluding such actuation upon exposure to sufficient light. After initial activation, the temporal delay circuitry is further adapted to remain activated for a predetermined amount of time despite the absence of motion hence permitting a person to exit the sensing field of view momentarily and return without having the lamps cycle off and on.

Finally, the sensor housing includes a rodlike member 30 connected to the garage door system housing with a pivotal fulcrum 32 wherein pivoting of the sensor housing is substantially in a vertical plane with the sensor element disposed in a first substantially horizontal direction and with the sensor element repositionable at any angle from the first substantially horizontal direction through a nadir passing through a pivotal axis and to a second substantially horizontal direction. The rotation of the rodlike member is substantially within a horizontal plane positioned about a substantially vertical axis passing through the pivotal axis and with such rotation occurring through angles somewhat less than three hundred and sixty degrees. The rodlike member additionally comprises an axially aligned conduit for containment of the input and output control lines.

Operation and use of the light and motion governed garage door opener lamp is facilitated by the amalgamation of the components discussed hereinabove. The lamp is capable of two modes of operation during use. The first mode actuates the lamps upon the activation of the garage door opening and closing system via the first relay. The second mode actuates the lamps upon the detection of humans via the motion sensor element. Both modes are inoperable when the light switch is in a open orientation due to exposure to sufficient light.

The present invention provides an advantageous light and motion governed garage door opener lamp which can be integrally manufactured with a garage door opener or easily retrofitted to a currently existing garage door opener. The delayed lamp extinguishment feature permits a person to stand motionless for an interval without the lamp switching to an off state. In addition, the light sensor switch prevents the actuation of the lamps during daylight hours thereby saving energy. The light and motion governed lamp is also very beneficial to disabled users who have difficulty entering an unlighted garage.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved sensor actuated garage door opener light for sensing the local presence of a human form and actuating an illumination system when there is insufficient light comprising, in combination:

an electrically powered garage door opening and closing system including a garage door; a housing; a plurality of lamps; a transformer coupled to a conventional power receptacle and adapted to supply an acceptable amount of current to the system; a security switch coupled to the transformer with an open orientation for precluding operation of the system and a closed orientation for allowing normal operation thereof; a receiver switch coupled in series with the security switch and adapted to allow transmission of current upon receipt of a radio signal; a manual switch coupled in series with the receiver switch and adapted to allow transmission of current upon the manual activation thereof; an upper limit switch coupled in series with the manual switch and adapted to allow transmission of current when the garage door is open; a lower limit switch coupled in series with the manual switch and adapted to allow transmission of current when the garage door is closed; an obstruction switch coupled in series with the manual switch and adapted to allow transmission of current when the garage door is obstructed; a first relay that transmits a first electric signal upon the activation thereof; a second relay coupled to an upward motor to effect opening of the garage door upon the activation thereof; a third relay coupled to a downward motor to effect closing of the garage door upon the activation thereof; an integrated circuit coupled between the upper limit switch, lower limit switch, and obstruction switch and the first relay, second relay, and third relay, the integrated circuit adapted to activate the first relay, second relay, and third relays upon the receipt of current via the upper limit switch, lower limit switch, and obstruction switch thereby effecting normal operation of the garage door system; and a sensor module including:

a sensor housing having a window that removes light at wavelengths not included in the infrared domain, a plurality of passive monostatic infrared sensor elements disposed within the housing at a location near the window, the sensor elements capable of detecting the presence of one or more humans within a sensing range and producing a second electrical signal whenever one or more humans are detected, a light sensor switch coupled to the motion sensor element and further coupled to the first relay via a relay control line, the light sensor switch having an open orientation when exposed to sufficient light for precluding the transmission of the first and second electric signals, the light sensor switch further having a closed orientation when exposed to insufficient light for allowing the transmission thereof, temporal delay circuitry coupled to the light sensor switch and comprising an input power control line coupled to the power receptacle, an input neutral control line, and an output power control line coupled to the lamps of the garage door system, the temporal delay circuitry adapted to allow transmission of current between the input power control line and output power control line upon the receipt of the first or second electric signal thereby allowing independent actuation of the lamps upon the detection of humans or activation of the garage door system and precluding said actuation upon exposure to sufficient light, the temporal delay circuitry further adapted to remain activated for a predetermined amount of time despite the absence of motion, and a rodlike member connected to the garage door system with a pivotal fulcrum wherein pivoting of the sensor housing is substantially in a vertical plane with the sensor element disposed in a first substantially horizontal direction and with the sensor element repositionable at any angle from the first substantially horizontal direction through a nadir passing through a pivotal axis and to a second substantially horizontal direction, and wherein rotation of the rodlike member is substantially within a horizontal plane positioned about a substantially vertical axis passing through the pivotal axis and with such rotation occurring through angles somewhat less than three hundred and sixty degrees, the rodlike member having an axially aligned conduit formed therein for containment of the input and output control lines.

2. A light and motion governed garage door opener illumination system comprising:

a garage door opener system that produces a first electric signal upon the activation thereof;

an illumination system; and a sensor module including:

a motion sensing means capable of detecting the presence of one or more humans nearby and producing a second electrical signal upon the detection thereof, and a light sensing means having an open orientation when exposed to sufficient light for allowing transmission of the first and second electric signals thereby allowing energization of the illumination system, the light sensor switch further having a closed orientation when exposed to insufficient light for precluding the transmission thereof thereby preventing energization of the illumination system, whereby the sensor module is adapted to generate a temporal delay in extinguishment of said illumination system upon initial energization in the absence of detection of any human forms.

3. A light and motion governed garage door opener lamp as set forth in claim 2 wherein said motion sensing means comprises a passive infrared detector.

4. A light and motion governed garage door opener lamp as set forth in claim 2 wherein said motion sensing means further includes a sensor housing having a window that removes light at wavelengths not included in the infrared domain.

* * * * *